US007273354B2

(12) United States Patent
Spaggiari

(10) Patent No.: US 7,273,354 B2
(45) Date of Patent: Sep. 25, 2007

(54) HIGH EFFICIENCY AXIAL FAN

(75) Inventor: Alessandro Spaggiari, Correggio (IT)

(73) Assignee: SPAL Automotive S.r.l., Correggio(Reggio Emilia) (IT)

( * ) Notice: Subject to any disclaimer, the term of this patent is extended or adjusted under 35 U.S.C. 154(b) by 0 days.

(21) Appl. No.: 10/570,805

(22) PCT Filed: Jul. 25, 2005

(86) PCT No.: PCT/IB2005/002266

§ 371 (c)(1),
(2), (4) Date: Mar. 6, 2006

(87) PCT Pub. No.: WO2006/016229

PCT Pub. Date: Feb. 16, 2006

(65) Prior Publication Data

US 2007/0020103 A1 Jan. 25, 2007

(30) Foreign Application Priority Data

Aug. 5, 2004 (IT) ..... BO2004A0507

(51) Int. Cl.
*F04D 29/38* (2006.01)

(52) U.S. Cl. ..... 416/238; 416/223 R; 416/DIG. 5

(58) Field of Classification Search ..... 416/223 R, 416/238, 243, DIG. 5
See application file for complete search history.

(56) References Cited

U.S. PATENT DOCUMENTS

| | | | | |
|---|---|---|---|---|
| 4,684,324 | A * | 8/1987 | Perosino | 416/189 |
| 5,273,400 | A | 12/1993 | Amr | |
| 6,086,330 | A | 7/2000 | Press et al. | |
| 6,554,574 | B1 * | 4/2003 | Spaggiari | 416/203 |
| 7,070,392 | B2 * | 7/2006 | Bradbury et al. | 416/243 |

FOREIGN PATENT DOCUMENTS

| | | |
|---|---|---|
| DE | 37 24 319 A1 | 2/1989 |
| EP | 1 016 788 A2 | 7/2000 |

* cited by examiner

*Primary Examiner*—Edward K. Look
*Assistant Examiner*—Nathan Wiehe
(74) *Attorney, Agent, or Firm*—The Nath Law Group; Jerald L. Meyer; Derek Richmond

(57) ABSTRACT

Disclosed is an axial fan (1) rotating in a plane (XY) about an axis (2) having a central hub (3) and a plurality of blades (4), which have a root (5) and a tip (6). The blades (4) are delimited by a concave leading edge (7), whose projection in the fan plane of rotation (XY) is defined by two circular arc segments, and a convex trailing edge (8), whose projection in the fan plane of rotation (XY) is defined by one circular arc segment. The blades (4) are made from sections with aerodynamic profiles relatively extending in the direction of their centre line, providing good flow rate and air pressure relative to the overall dimensions of the fan.

20 Claims, 3 Drawing Sheets

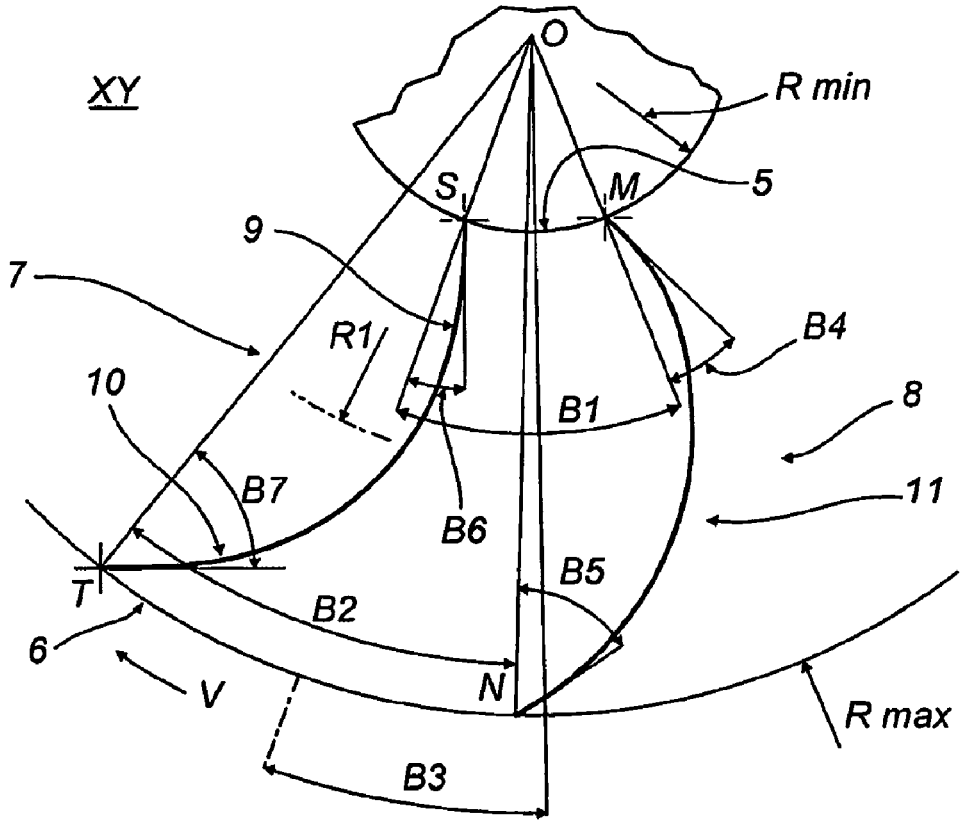
FIG. 4
FIG. 4a
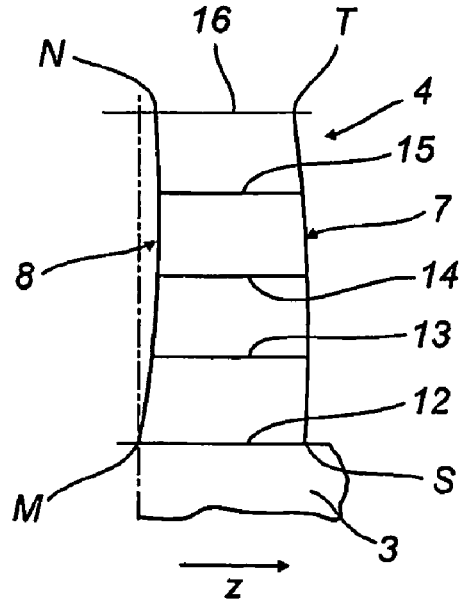

HIGH EFFICIENCY AXIAL FAN

TECHNICAL FIELD

The present invention relates to an axial fan with blades angled in the fan plane of rotation.

The fan according to the present invention may be used in various applications, for example, to move air through a heat exchanger, or radiator, of a cooling system for the engine of a motor vehicle or the like.

A specific sector for application of the fan according to the present invention is that of conditioning systems, that is to say, heating and/or air conditioning for the interior of motor vehicles.

BACKGROUND ART

Fans of this type must satisfy various requirements, including: low noise level, high efficiency, compactness, capacity to achieve good pressure and flow rate values.

Patent EP-O 553 598, by the same Applicant, presents a fan with blades delimited at the leading edge and trailing edge by two curves which are two circular arcs when projected in the fan plane of rotation.

Fans constructed in accordance with said patent provide good efficiency and low noise, but have limits as regards the possibility of achieving high pressure values, since the blades are made with profiles whose centre line is relatively short compared with the blade radial extension.

Moreover, fans constructed in accordance with the above-mentioned patent have a limited axial dimension, but a relatively large diameter.

For the exchanger units of heating and/or air conditioning systems for the interior of motor vehicles the overall dimensions of the fan must be limited, which means that the diameter must also be limited, whilst good air flow rates are required with high pressure and low noise.

For these reasons, in the above-mentioned exchanger units centrifugal fans are often used, which may have a relatively small diameter, but with a rather large axial dimension.

DISCLOSURE OF THE INVENTION

One aim of the present invention is to provide a fan which has generally limited dimensions, which can develop good air flow rates with high pressure and low noise values.

According to one aspect of the present invention, an axial fan rotating in a plane about an axis has a central hub and a plurality of blades, which have a root and a tip. The blades are delimited by a concave leading edge, whose projection in the fan plane of rotation is defined by two circular arc segments, and a convex trailing edge, whose projection in the fan plane of rotation is defined by one circular arc segment. The blades are made from sections with aerodynamic profiles relatively extending in the direction of their centre line, providing good flow rate and air pressure relative to the overall dimensions of the fan.

The dependent claims refer to preferred and advantageous embodiments of the invention.

BRIEF DESCRIPTION OF THE DRAWINGS

The invention is described in more detail below with reference to the accompanying drawings, which illustrate a preferred, non-limiting embodiment, in which:

FIG. 4 is a schematic front view of a blade of the fan illustrated in the previous figures;

FIG. 4*a* is a schematic side view of a blade of the fan illustrated in the previous figures;

DETAILED DESCRIPTION OF THE PREFERRED EMBODIMENTS OF THE INVENTION

Figure 1:
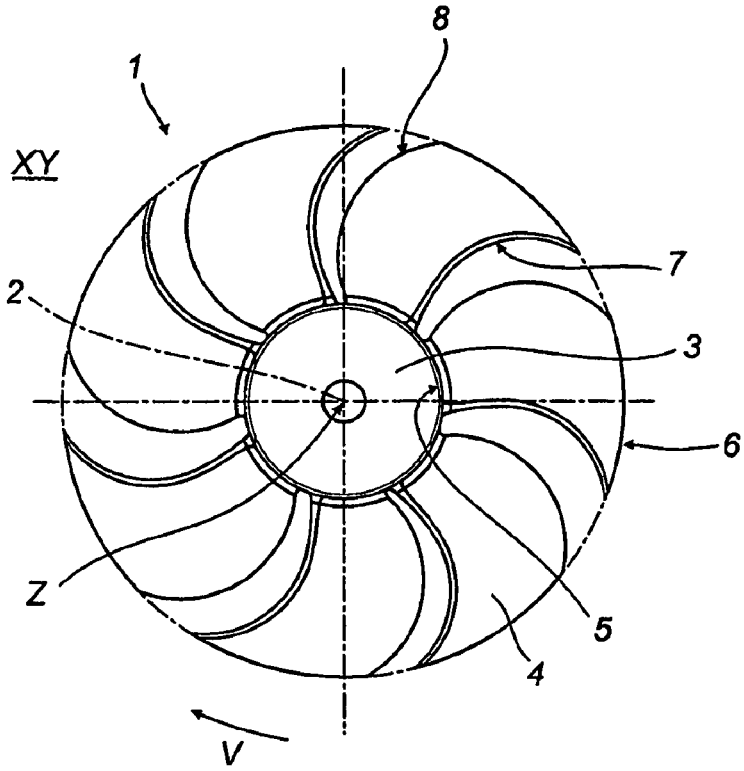
FIG. 1 is a front view of the fan in accordance with the present invention.
Figure 2:
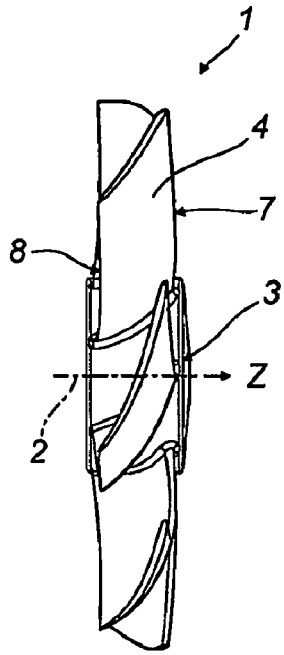
FIG. 2 is a side projection view of the fan illustrated in FIG. 1.
Figure 3:
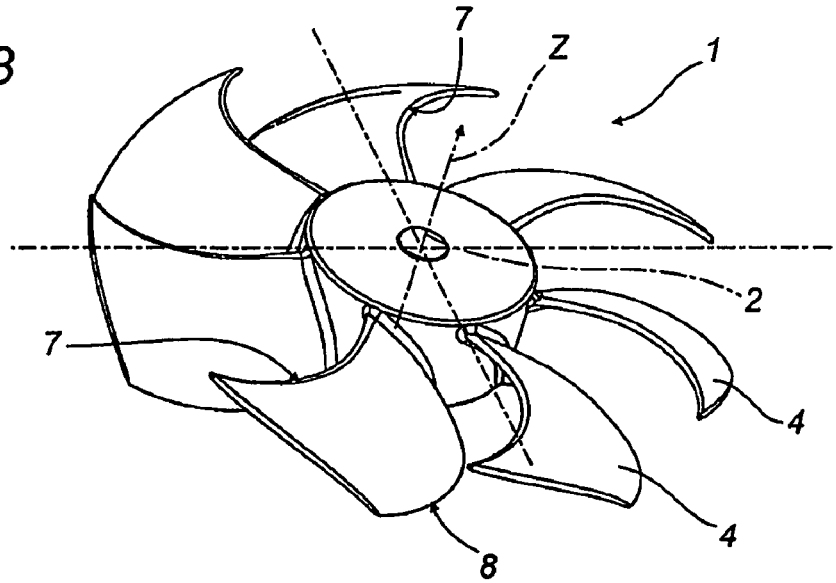
FIG. 3 is a perspective view of the fan illustrated in the previous figures.

With reference to the accompanying drawings, the fan 1 rotates about an axis 2 in a plane XY and comprises a central hub 3, with a centre o, to which a plurality of blades 4 are connected, the blades being curved in the fan 1 plane of rotation XY.

The blades 4 have a root 5, a tip 6 and are delimited by a concave leading edge 7 and a convex trailing edge 8.

For the best results in terms of efficiency, flow rate and air pressure, the fan 1 rotates with a direction of rotation V, illustrated in FIGS. 1 and 4, so that the tip 6 of each blade 4 encounters the air flow before the root 5.

FIG. 4 illustrates an example of the geometric characteristics of a blade 4 the leading edge 7 is delimited by two circular arc segments 9, 10, and the trailing edge 8 is delimited by one circular arc segment 11.

In the leading edge 7, a radius labelled R1 is the point of change from one circular arc segment to the other circular arc segment.

According to the example in FIG. 4, the general dimensions of the projection of a blade 4 in the plane XY are summarised in table 1

TABLE 1

| dimensions of a blade 4. | | | |
|---|---|---|---|
| | Radius of internal segment (mm) | Radius of change (mm) | Radius of external segment (mm) |
| Leading edge (Ref. 7) | 59.37 (Ref. 9) | 48.79 (Ref. R1) | 27.52 (Ref. 10) |
| | Radius (mm) | | |
| Trailing edge (Ref. 8) | 31.73 (Ref. 11) | | |

The general geometric characteristics of the blade 4 are defined relative to a hub with 55 mm diameter, that is to say, the blade 4 has a minimum radius Rmin=27.5 mm at the root 5, and a fan 1 external diameter of 155 mm, therefore that the blade 4 has a maximum radius Rmax=77.5 mm at the tip 6; meaning that the blade 4 has a 50 mm radial extension.

Considering that the blade 4 has a minimum radius Rmin=27.5 mm and a maximum radius Rmax=77.5 mm, the leading edge 7 has a radius R1, where the change in the circular arc occurs, corresponding to 42.6% of the radial extension of the leading edge 7 (starting at the root 5), an extension which, as already indicated, is 50 mm.

The part 9 of the leading edge 7 closest to the root 5 consists of a circular arc with a radius equal to around 76.6% of the radius Rmax, and the part 10 of the leading edge 7 closest to the tip 6 consists of a circular arc segment with a radius equal to around 35.5% of the radius Rmax of the blade 4.

As regards the trailing edge 8, the circular arc segment 11 has a radius equal to around 40.9% of the radius Rmax of the blade 4.

The dimensions in percentages are summarised in table 2

TABLE 2 blade 4 dimensions in percentage form.

| | Internal segment radius (% of Rmax) | Change radius (% of blade extension = Rmax-Rmin) | External segment radius (% of Rmax) |
|---|---|---|---|
| Leading edge (Ref. 7) | 76.6 (Ref. 9) | 42.6 (Ref. R1) | 35.5 (Ref. 10) |
| | Radius (% of Rmax) | | |
| Trailing edge (Ref. 8) | | 40.9 (Ref. 11) | |

Satisfactory results in terms of flow rate, pressure and noise were achieved even with values around these percentage dimensions In particular, variations of 10% more or less on the above-mentioned dimensions are possible.

The percentage ranges relative to the dimensions are summarised in table 3:

TABLE 3

Blade 4 edges percentage ranges.

| | Internal segment radius (% of Rmax) | Change radius (% of blade extension = % of Rmax-Rmin) | External segment radius (% of Rmax) |
|---|---|---|---|
| Leading edge (Ref. 7) | 68.9-84.3 (Ref. 9) | 38.3-46.9 (Ref. R1) | 32-39 (Ref. 10) |
| | Radius (% Rmax) | | |
| Trailing edge (Ref. 8) | | 36.8-45 (Ref. 11) | |

For the leading edge 7, in the circular arc segment change zone, there may be a suitable fillet so that the edge 7 is continuous and free of cusps.

As regards the width or angular extension of the blades, again with reference to FIG. 4, the projection of the blade 4 in the plane xy has an amplitude, at the root 5, represented by an angle B1 relative to the centre 0 of the fan 1 of around 41 degrees and an amplitude, at the tip 6, represented by an angle B2 relative to the centre 0 of around 37 degrees.

Again, satisfactory results were achieved in terms of flow rate, pressure and noise with values of angles B1, B2 around these values. In particular, variations of 10% more or less than the angles indicated are possible. The angle B1 may vary from 36.9 to 45.1 degrees, whilst the angle B2 may vary from 33.3 to 40.7 degrees.

In general, it must also be considered that, due to the plastic material used to make fans, variations in all of the dimensions and angles of 5% more or less must all be considered within the values indicated.

Considering, for example, the respective bisecting lines of the angles B1, B2 and following the fan 1 direction of rotation V, the tip 6 is further forward than the root 5 by an angle B3 of around 15.6 degrees.

Other angles characteristic of the blade 4 are angles B4, B5, B6, B7 (FIG. 4) formed by the respective tangents to the two edges 7, 8 and by the respective lines passing through points S, T, N, M: the angles B4 and B5 are respectively 26 and 59 degrees and the angles B6, B7 are respectively 22 and 57 degrees. There may be between four and nine blades 4 and, according to a preferred embodiment, there are seven blades 4 and they are separated by angles that are not equal.

The angles to the centre 0, between one blade and another—considering for example the corresponding leading edges 7 or trailing edges 8—are: 51; 106; 157; 204; 259; 311 (degrees).

These angles provide advantages in terms of noise, whilst the fan 1 remains completely statically and dynamically balanced.

Each blade 4 consists of a set of aerodynamic profiles which gradually join up starting from the root 5 towards the tip 6.

Figure 6:
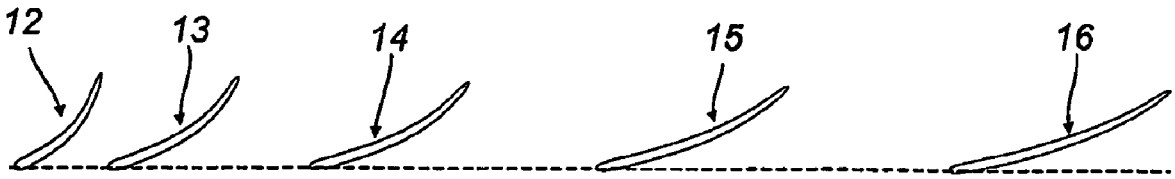
FIG. 6 is a cross-section of several profiles at various fan diameters.

FIG. 6 illustrates five profiles 12-16, relative to respective sections at various intervals along the radial extension of a blade 4.

Figure 5:
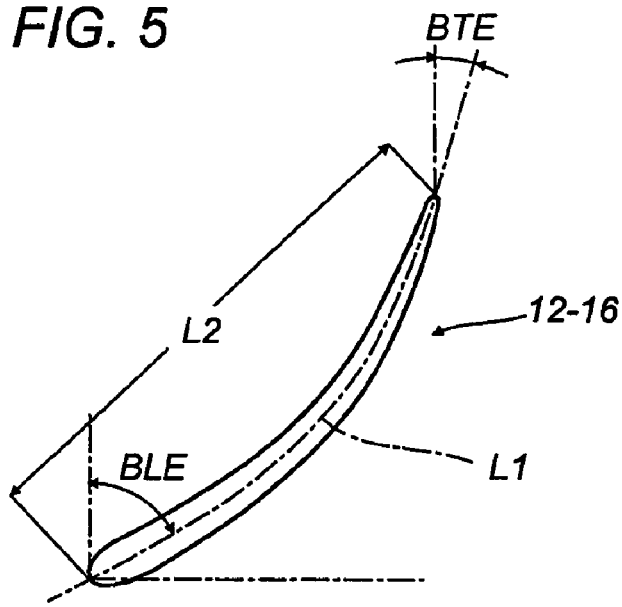
FIG. 5 is a cross-section of a profile and the respective geometric characteristics.

The profiles 12-16 are also formed by the geometric characteristics of which an example is provided in FIG. 5 for one of the profiles, specifically illustrating profile 12.

As illustrated in Figures, each profile 12-16 is formed by a continuous centre line L1 without points of inflection or cusps and by a chord L2.

Each profile 12-16 is also formed by angles BLE, BTE of incidence with the leading edge and with the trailing edge, said angles formed by the respective tangents to the centre line L1 at the point of intersection with the leading edge and with the trailing edge and a respective straight line perpendicular to the plane XY passing through the corresponding points of intersection.

With reference to the five profiles 12-16, table 4 below indicates the angles of the leading edge BLE and of the trailing edge BTE, the length of the centre line L1 and the chord L2 of the profiles of a blade 4.

TABLE 4

Radial position, angles of leading and trailing edges, length of centre line and chord of the profiles of a blade 4.

| Profile | Radial position (%) | Radius (mm) | BLE (degrees) | BTE (degrees) | L1 (centre line mm) | L1 % (% centre line relative to Rmax) | L2 (chord mm) |
|---|---|---|---|---|---|---|---|
| 12 | 0 | 27.5 | 65 | 20 | 30.5982 | 39.48% | 29.41 |
| 13 | 26.25 | 40.6 | 72 | 30 | 37.0907 | 47.86% | 35.99 |
| 14 | 50.87 | 52.9 | 75 | 42 | 41.9862 | 54.18% | 41.19 |
| 15 | 75.46 | 65.2 | 77 | 50 | 47.7623 | 61.63% | 47.22 |
| 16 | 100 | 77.5 | 79 | 55 | 53.4942 | 69.02% | 53.02 |

It should be noticed that the centre line L1 has values which are important percentages of the fan 1 radius and which increase from a minimum value at the hub to a maximum value at the tip of the blade.

Again, good results can be achieved with values around these percentage dimensions. In particular, variations of 10% more or less on the above-mentioned dimensions are possible.

The percentage ranges relative to the length of the centre line are summarised in table 4a below:

TABLE 4a

Radial position - % range of length of centre line of profiles of a blade 4.

| Profile (Reference) | % radial position | Radius radial position (mm) | LI % range (% centre line relative to Rmax) | |
|---|---|---|---|---|
| 12 | 0 | 27.5 | 35.5% | 43.4% |
| 13 | 26.25 | 40.6 | 43.1% | 52.6% |
| 14 | 50.87 | 52.9 | 48.8% | 59.6% |
| 15 | 75.46 | 65.2 | 55.5% | 67.8% |
| 16 | 100 | 77.5 | 62.1% | 75.9% |

It should be noticed that the thickness of each profile 12-16, according to a typical trend of wing-shaped profiles, initially increases, reaching a maximum value S-MAX at around 20% of the length of the centre line L1, then it gradually decreases as far as the trailing edge 8.

In percentages, the thickness S-MAX is between 2.81% and 2.88% of the radius Rmax; the thickness of the profiles is distributed symmetrically relative to the centre line L1.

The positions of the profiles 12-16 relative to the radial extension of a blade 4 and the relative values for the thickness trend according to their position with respect to the centre line L1 are summarised in table 5.

TABLE 5

Radial position and thickness trend of blade 4 profiles.

| | | | | Thickness | | | | | |
|---|---|---|---|---|---|---|---|---|---|
| | | | | dimensionless relative to S-MAX | | | | | |
| Profile | Radial pos. % | Radius (mm) | S-MAX (mm) | 0% L1 | 20% L1 | 40% L1 | 60% L1 | 80% L1 | 100% L1 |
| 12 | 0 | 27.5 | 2.18 | 0.570765 | 1 | 0.844404 | 0.703746 | 0.598529 | 0.10986 |
| 13 | 26.25 | 40.6 | 2.23 | 0.600601 | 1 | 0.89373 | 0.763659 | 0.622563 | 0.126933 |
| 14 | 50.87 | 52.9 | 2.23 | 0.642517 | 1 | 0.921272 | 0.803741 | 0.652252 | 0.145792 |
| 15 | 75.46 | 65.2 | 2.21 | 0.689833 | 1 | 0.93394 | 0.81485 | 0.655626 | 0.16592 |
| 16 | 100 | 77.5 | 2.19 | 0.737872 | 1 | 0.920047 | 0.782595 | 0.624287 | 0.186373 |

Table 6 below summarises the actual mm values of the trend of thicknesses according to their position with respect to the centre Line L1 for each profile 12-16 with reference to the embodiment illustrated.

TABLE 6

Thickness trend in mm of blade 4 profiles 12-16.

| | Thickness (mm) | | | | | |
|---|---|---|---|---|---|---|
| Profile | 0% L1 | 20% L1 | 40% L1 | 60% L1 | 80% L1 | 100% L1 |
| 12 | 1.24 | 2.18 | 1.84 | 1.53 | 1.30 | 0.24 |
| 13 | 1.34 | 2.23 | 1.99 | 1.70 | 1.39 | 0.28 |
| 14 | 1.43 | 2.23 | 2.05 | 1.79 | 1.45 | 0.33 |

TABLE 6-continued

Thickness trend in mm of blade 4 profiles 12-16.

| | Thickness (mm) | | | | | |
|---|---|---|---|---|---|---|
| Profile | 0% L1 | 20% L1 | 40% L1 | 60% L1 | 80% L1 | 100% L1 |
| 15 | 1.52 | 2.21 | 2.06 | 1.80 | 1.45 | 0.37 |
| 16 | 1.62 | 2.19 | 2.02 | 1.71 | 1.37 | 0.41 |

The profiles 12-16 are preferably delimited with an elliptical fillet, on the leading edge 7 side, and with a truncation created using a segment of a straight line on the trailing edge 8 side.

FIG. 4*a* is a schematic illustration of a meridian section, that is to say, a lateral section extending in the direction of a radius, of the fan 1 at a blade 4 making the trends of the edges 7 and 8 evident.

Table 7 below shows the position mm values relative to an axis Z perpendicular to the plane XY and taking the lower edge of the hub 3 as a reference.

TABLE 7

Trend of blade 4 profiles 12-16 relative to a meridian section.

| Profile (Reference) | Leading edge mm (Ref. 7) | Trailing edge mm (Ref. 8) |
|---|---|---|
| 12 | 22.4251 | 0.474211 |
| 13 | 22.9038 | 1.92382 |
| 14 | 22.6888 | 2.66545 |
| 15 | 21.8639 | 2.75294 |
| 16 | 20.6228 | 2.20486 |

This table indicates that each blade 4 has a maximum axial dimension at the hub 3, and that it is 21.95 mm, that is to say, in terms of percentages, the blade 4 has a maximum axial dimension which is 28.32% of the radius Rmax.

Therefore, it may be seen that the blade 4 extends quite considerably in an axial direction and that said axial dimension is almost a third of the maximum radius Rmax of the fan 1.

The table below summarises the axial extension values in the various profiles 12-16 expressed in mm, as a percentage value relative to the fan 1 maximum radius, and with a percentage range of 10% more or less. The axial extension values in said ranges also provided satisfactory results.

TABLE 8

| Percentage trend of blade 4 profiles 12-16 relative to a meridian section. | | | | |
|---|---|---|---|---|
| Profile (Reference) | Axial extension (mm) | Percentage axial extension relative to Rmax | Axial extension - % ranges relative to Rmax | |
| 12 | 21.95 | 28.32% | 25.5% | 31.2% |
| 13 | 20.98 | 27.07% | 24.4% | 29.8% |
| 14 | 20.02 | 25.83% | 23.2% | 28.4% |
| 15 | 19.11 | 24.66% | 22.2% | 27.1% |
| 16 | 18.42 | 23.77% | 21.4% | 26.1% |

The fan according to the present invention achieves optimum performance in terms of efficiency, flow rate and air pressure with very compact overall dimensions.

Thanks to the special design of the blades, with particularly aerodynamically efficient profiles, the noise level is also very low.

The axial fan disclosed is capable of performance comparable with that of centrifugal fans with significantly smaller dimensions.

These features are especially advantageous in air conditioning systems and the like for motor vehicles, in which reducing the dimensions is very important.

The invention described may be subject to modifications and variations without thereby departing from the scope of the inventive concept described in the claims herein.

LIST OF REFERENCE CHARACTERS

| Reference | Description |
|---|---|
| 1 | AXIAL FAN |
| 2 | AXIS OF ROTATION |
| 3 | CENTRAL HUB |
| 4 | FAN 1 BLADE |
| 5 | BLADE 4 ROOT |
| 6 | BLADE 4 TIP |
| 7 | CONCAVE LEADING EDGE |
| 8 | CONVEX TRAILING EDGE |
| 9 | CIRCULAR ARC SEGMENT (INTERNAL) |
| 10 | CIRCULAR ARC SEGMENT (EXTERNAL) |
| 11 | CIRCULAR ARC SEGMENT |
| 12-16 | AERODYNAMIC PROFILES |
| O | CENTRE OF FAN 1 |
| XY | ROTATION PLANE |
| V | DIRECTION OF ROTATION |
| R1 | RADIUS OF CHANGE BETWEEN SEGMENTS 9 AND 10 |
| XY | PLANE |
| Z | AXIS |
| B1-B7 | BLADE 4 CHARACTERISTIC ANGLES |
| M, N, S, T | BLADE 4 CHARACTERISTIC POINTS |
| L1 | CENTRE LINE |
| L2 | CHORD |
| BLE | LEADING EDGE ANGLES OF INCIDENCE |
| BTE | TRAILING EDGE ANGLES OF INCIDENCE |

The invention claimed is:

1. An axial fan (1), rotating in a direction (V) in a plane (XY) about an axis (2), comprising a central hub (3) with a centre (0) and a radius Rmin, a plurality of blades (4) each having a root (5), a tip (6) which extends to a tip radius (Rmax), the blades (4) being delimited by a concave leading edge (7) and a convex trailing edge (8), and being formed by several aerodynamic profiles (12-16) relative to sections at various intervals along the radial extension of a blade (4), each profile (12-16) being formed by a centre line (L1) which is continuous without points of inflection or cusps, the axial fan being characterised in that the length of the centre line (L1) for each profile (12-16) is defined by a percentage range relative to the maximum radius Rmax of the fan (1) as indicated in the following table:

| Profile (Reference) | % radial position (% of blade extension = % of Rmax-Rmin) | L1 % r ange (centre line % range relative to Rmax) | |
|---|---|---|---|
| (12) | 0 | 35.5% | 43.4 |
| (13) | 26.25 | 43.1% | 52.6 |
| (14) | 50.87 | 48.8% | 59.6 |
| (15) | 75.46 | 55.5% | 67.8 |
| (16) | 100 | 62.1% | 75.9 |

2. The axial fan (1) according to claim 1, characterised in that each profile (12-16) is formed by an axial extension with percentage length ranges relative to the maximum radius Rmax of the fan (1) as indicated in the following table:

| Profile (Reference) | % radial position C. % of blade extension = % of | Axial extension - ranges relative to Rmax | |
|---|---|---|---|
| (12) | 0 | 25.5% | 31.2% |
| (13) | 26.25 | 24.4% | 29.8% |
| (14) | 50.87 | 23.2% | 28.4% |
| (15) | 75.46 | 22.2% | 27.1% |
| (16) | 100 | 21.4% | 26.1% |

3. The axial fan (1) according to claim 1, characterised in that the leading edge (7) comprises a first circular arc segment (9) close to the root (5) with a radius which is between 68.9% and 84.3% of the tip radius (Rmax) and a second circular arc 5 segment (10) close to the tip (6) with a radius which is between 32% and 39% of the tip radius (Rmax), and a radius at the change between the two circular arc segments (9, 10) which is between 38.3% and 46.9% of the extension (Rmax-Rmin) of the blade (4).

4. The axial fan (1) according to claim 1, characterised in that the trailing edge (8) comprises a circular arc segment (11) with a radius which is between 36.8% and 45% of the tip radius (Rmax).

5. The axial fan (1) according to claim 1, characterised in that the leading edge (7) comprises a first circular arc segment (9) close to the root (5) with a radius which is 76.6% of the tip radius (Rmax) and a second circular arc segment (10) close to the tip (5) with a radius which is 35.5% of the tip radius (Rmax), and a radius R1 at the change between the two circular arc segments (9, 10) which is 42.6% of the extension (Rmax-Rmin) of the blade (4).

6. The axial fan (1) according to claim 1, characterised in that the trailing edge (8) comprises a circular arc segment (11) with a radius which is 40.9% of the tip radius (Rmax).

7. The axial fan (1) according to claim 1, characterised in that the projection of the blade (4) in the plane (XY) has an amplitude, at the root (5), with an angle (B1) relative to the centre (0) of between 36.9 and 45.1 degrees.

8. The axial fan (1) according to claim 1, characterised in that the projection of the blade (4) in the plane (XY) has an amplitude, at the tip (6), with an angle (B2) relative to the centre (0) of between 33.3 and 40.7 degrees.

9. The axial fan (1) according to claim 1, characterised in that the projection of the blade (4) in the plane (XY) has an amplitude, at the root (5), with an angle (B1) relative to the centre (0) of around 41 degrees.

10. The axial fan (1) according to claim 1, characterised in that the projection of the blade (4) in the plane (XY) has an amplitude, at the tip (6), with an angle (B2) relative to the centre (0) of around 37 degrees.

11. The axial fan (1) according to claim 1, characterised in that, considering the projection of the blade (4) in the plane (XY) and fan (1) direction of rotation (V), the tip (6) is further forward than the root (5) by an angle (B3) relative to the centre (0) of around 15.6 degrees.

12. The axial fan (1) according to claim 1, characterised in that the projection of the blade (4) in the plane (XY) forms a point (M) of intersection between the trailing edge (8) and the hub (3) with an angle (B4) of 26 degrees, the angle (B4) being formed by the respective tangent to the trailing edge (8) at the point (M) and by a respective line from the centre (0) of the fan (1) passing through the point (M).

13. The axial fan (1) according to claim 1, characterised in that the projection of the blade (4) in the plane (XY) forms a point (N) of intersection between the trailing edge (8) and the tip (6) with an angle (B5) of 59 degrees, the angle (B5) being formed by the respective tangent to the trailing edge (8) at the point (N) and by a respective line from the centre (0) of the fan (1) passing through the point (N).

14. The axial fan (1) according to claim 1, characterised in that the projection of the blade (4) in the plane (XY) forms a point (S) of intersection between the leading edge (7) and the hub (3) with an angle (B6) of 22 degrees, the angle (B6) being formed by the respective tangent to the leading edge (7) at the point (S) and by a respective line from the centre (0) of the fan (1) passing through the point (S).

15. The axial fan (1) according to claim 1, characterised in that the projection of the blade (4) in the plane (XY) forms a point (T) of intersection between the leading edge (7) and the tip (6) with an angle (B7) of 57 degrees, the angle (B7) being formed by the respective tangent to the leading edge (7) at the point (T) and by a respective line from the centre (0) of the fan (1) passing through the point (T).

16. The axial fan (1) according to claim 1, characterised in that each profile (12-16) is formed by two angles (BLE, BTE) of incidence with the leading edge and the trailing edge, the angles being formed by the respective tangents to the centre line (L1) at the point of intersection with the leading edge and with the trailing edge and a respective straight line perpendicular to the plane (XY) passing through the corresponding points of intersection and also being characterised in that the angles (BLE, BTE) of the profiles (12-16) have the values indicated in the following table:

| Profile | Radial position % | Radius (nun) | BLE (degrees) | BTE (degrees) |
|---|---|---|---|---|
| (12) | 0 | 27.5 | 65 | 20 |
| (13) | 26.25 | 40.6 | 72 | 30 |
| (14) | 50.87 | 52.9 | 75 | 42 |
| (15) | 75.46 | 65.2 | 77 | 50 |
| (16) | 100 | 77.5 | 79 | 55 |

17. The axial fan (1) according to claim 1, characterised in that each profile (12-16) is defined by the values of the positions (in mm) relative to an axis (Z) perpendicular to the plane (XY), taking the lower edge of the hub (3) as a reference, expressed in the following table:

| Profile (Reference) | Leading edge MM. (Ref. 7) | Trailing edge mm (Ref. 8) |
|---|---|---|
| (12) | 22.4251 | 0.474211 |
| (13) | 22.9038 | 1.92382 |
| (14) | 22.6888 | 2.66545 |
| (15) | 21.8639 | 2.75294 |
| (16) | 20.6228 | 2.20486 |

18. The axial fan (1) according to claim 1, characterised in that each profile (12-16) has a thickness S-MAX arranged symmetrically relative to the centre line (L1) and has values within the range of between 2.81% and 2.88% of the tip radius Rmax.

19. according to claim 18, characterised in that the profiles (12-16) have a thickness which is arranged symmetrically relative to the centre line (L1) and a thickness trend that is initially increasing, a maximum value S-MAX at around 20% of the length of the centre line (L1), and then gradually decreasing as far as the trailing edge (8) and also being characterised in that the thickness trend is defined by the following table:

| | | | | Thickness | | | | | |
|---|---|---|---|---|---|---|---|---|---|
| | | | | dimensionless relative to S-MAX | | | | | |
| Profile | Radial Position % | Radius (mm) | S-MAX (mm) | 0% L1 | 20% L1 | 40% L1 | 60% L1 | 80% L1 | 100% L1 |
| (12) | 0 | 27.5 | 2.18 | 0.570765 | 1 | 0.844404 | 0.703746 | 0.59852 | 0.10986 |
| (13) | 26.25 | 40.6 | 2.23 | 0.600601 | 1 | 0.89373 | 0.763659 | 0.62256 | 0.126933 |
| (14) | 50.87 | 52.9 | 2.23 | 0.642517 | 1 | 0.921272 | 0.803741 | 0.65225 | 0.145792 |

-continued

| | | | | Thickness | | | | | |
|---|---|---|---|---|---|---|---|---|---|
| | | | | dimensionless relative to S-MAX | | | | | |
| Profile | Radial Position % | Radius (mm) | S-MAX (mm) | 0% L1 | 20% L1 | 40% L1 | 60% L1 | 80% L1 | 100% L1 |
| (15) | 75.46 | 65.2 | 2.21 | 0.689833 | 1 | 0.93394 | 0.81485 | 0.65562 | 0.16592 |
| (16) | 100 | 77.5 | 2.19 | 0.737872 | 1 | 0.920047 | 0.782595 | 0.62428 | 0.186373 |

20. The axial fan (1) according to claim 1, comprising seven blades (4) arranged at angles that are not equal; said angles, expressed in degrees, between on blade (4) and another—considering for example the corresponding leading edges (7) or trailing edges (8)—are: 51; 106; 157; 204; 259; 311.

* * * * *

UNITED STATES PATENT AND TRADEMARK OFFICE

CERTIFICATE OF CORRECTION

PATENT NO. : 7,273,354 B2
APPLICATION NO. : 10/570805
DATED : September 25, 2007
INVENTOR(S) : Spaggiari It is certified that error appears in the above-identified patent and that said Letters Patent is hereby corrected as shown below:

Claim 19, Column 10, Line 48,
Please delete "according to claim 18,"
and
replace with
-- The axial fan (1) according to claim 18, --

Signed and Sealed this

Eighteenth Day of December, 2007

JON W. DUDAS
*Director of the United States Patent and Trademark Office*